United States Patent [19]

Specktor

[11] 4,282,740

[45] Aug. 11, 1981

[54] HEIGHT EXTENDER FOR USE IN CONNECTION WITH AN APPARATUS FOR REPAIRING AND STRAIGHTENING

[76] Inventor: Gerald A. Specktor, 409 Cleveland Ave. South, St. Paul, Minn. 55105

[21] Appl. No.: 63,608

[22] Filed: Aug. 3, 1979

[51] Int. Cl.[3] ..... B21D 1/12; B21D 1/14

[52] U.S. Cl. ..... 72/461; 72/705

[58] Field of Search ..... 72/457, 705, 461; 254/88, 90

[56] References Cited

U.S. PATENT DOCUMENTS

| | | | |
|---|---|---|---|
| 1,889,187 | 11/1932 | Wochner | 72/705 X |
| 2,140,686 | 12/1938 | Bennett | 72/705 X |
| 2,563,527 | 8/1951 | Gingrich et al. | 72/705 X |
| 2,692,002 | 10/1954 | Merrill et al. | 72/705 |
| 3,276,237 | 10/1966 | Transue | 72/705 X |
| 3,377,834 | 4/1968 | Latuff et al. | 72/705 X |
| 4,151,737 | 5/1979 | Specktor | 72/705 X |

*Primary Examiner*—Lowell A. Larson
*Attorney, Agent, or Firm*—Wicks & Nemer

[57] ABSTRACT

Height extender for use in an apparatus for repairing and straightening is disclosed in its preferred form for use in connection with apparatus for repairing and straightening the body and frame of a vehicle, most preferably a high ground clearance vehicle. The apparatus for repairing and straightening includes a tread member allowing placement of the vehicle thereon and having a plurality of apertures passing vertically therethrough. Bolsters, well known in the prior art, are removably held in the tread apertures by a locking member. The height extender includes a sleeve member, a plate attached to the sleeve member having an abutting portion and an elongated bar portion, and first and second bracing members attached to the elongated bar portion and the sleeve member. The sleeve member is received and slidable on the bolster. The height extender can then be positioned on the bolster at multilevel positions by a pin which passes through apertures formed in the bracing members. The elongated bar portion is spaced from the bolster when the bolster is located within the sleeve member, and the elongated bar portion does not contact the bolster when a counterforce is transferred to the bolster by the height extender, as insured by the bracing members, such that the counterforce is only transferred to the bolster by the sleeve member at a position adjacent to the tread member and not transferred to the bolster by the plate or bracing members to avoid an undue amount of cantilever type counterforce into the tread member or the bolster.

18 Claims, 4 Drawing Figures

HEIGHT EXTENDER FOR USE IN CONNECTION WITH AN APPARATUS FOR REPAIRING AND STRAIGHTENING

BACKGROUND

The present invention relates generally to an accessory for an apparatus for repairing and straightening vehicles, more particularly to a height extender, and most specifically to a height extender for use in an apparatus for repairing and straightening vehicles.

With the increasing sophistication of apparatus for repairing and straightening, faster repairing and straightening of damaged vehicles has been attained with less expenditures of time, labor, and energy. There is also an increasing need for accessories for use in such apparatus for repairing and straightening to further increase their ability to repair all types of vehicles having various types of damages and to further increase their range and efficiency to thus further reduce the time, labor, and effort required to repair and straighten vehicles.

Also such accessories should be easy to use without the need to strip away parts of the vehicle to be repaired in order to hold the vehicle for repairing and straightening.

Still further, such apparatus should be light in weight and of small size while maintaining sufficient strength to avoid damage, and still allow easy use thereof without the expenditures of large amounts of time and energy.

A special need has arisen for accessories for use in repairing high ground clearance vehicles such as small trucks, four wheel drives, and intermediate trucks. Previous known apparatus used in anchoring such vehicles has been very heavy and bulky, required extremely large amounts of energy and time to attach, and in many cases, demanded that vehicles be taken apart and stripped in order to be held for repair. Not only are these vehicles strongly built, but they are built higher off the ground to thereby require substantial holding devices.

SUMMARY

The present invention solves these and other problems in accessories for use with an apparatus for repairing and straightening by providing, in the preferred embodiment, a novel height extender. The apparatus for repairing and straightening has structure for receiving the counterforces from the vehicle which are produced by the application of a repair force. Such structure includes an upright member shown in the preferred embodiment as a bolster. The height extender is received on the upright member and includes a vehicle abutting portion, a member for transferring the counterforces, and a member connecting together and yet spacing the vehicle abutting portion and the counterforce transferring member. According to the present invention, the only portion of the height extender contacting the upright member is the counterforce transferring member, thus all counterforces are transferred to the upright member by the counterforce transferring member alone and only adjacent to the structure for receiving the counterforces to avoid an undue amount of cantilever type counterforce into the structure or the upright member.

It is thus a primary object of the present invention to provide a novel height extender.

It is a further object of the present invention to provide a novel height extender for use in an apparatus for repairing and straightening.

It is a further object of the present invention to provide such a novel height extender for accepting the counterforce during the repair of high ground clearance vehicles.

It is a further object of the present invention to provide such a novel height extender which receives counterforces from any direction.

It is a further object of the present invention to provide such a novel height extender which transmits the counterforce to a point adjacent to the counterforce receiving structure of the apparatus for repairing and straightening to avoid an undue amount of cantilever type counterforce into the structure.

It is a further object of the present invention to provide such a novel height extender which maximizes the material used.

It is a further object of the present invention to provide such a novel height extender that it is easy to use in conjunction with an apparatus for repairing and straightening.

It is a further object of the present invention to provide such a novel height extender that can be adjusted for any height of vehicles, such as high ground clearance vehicles.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
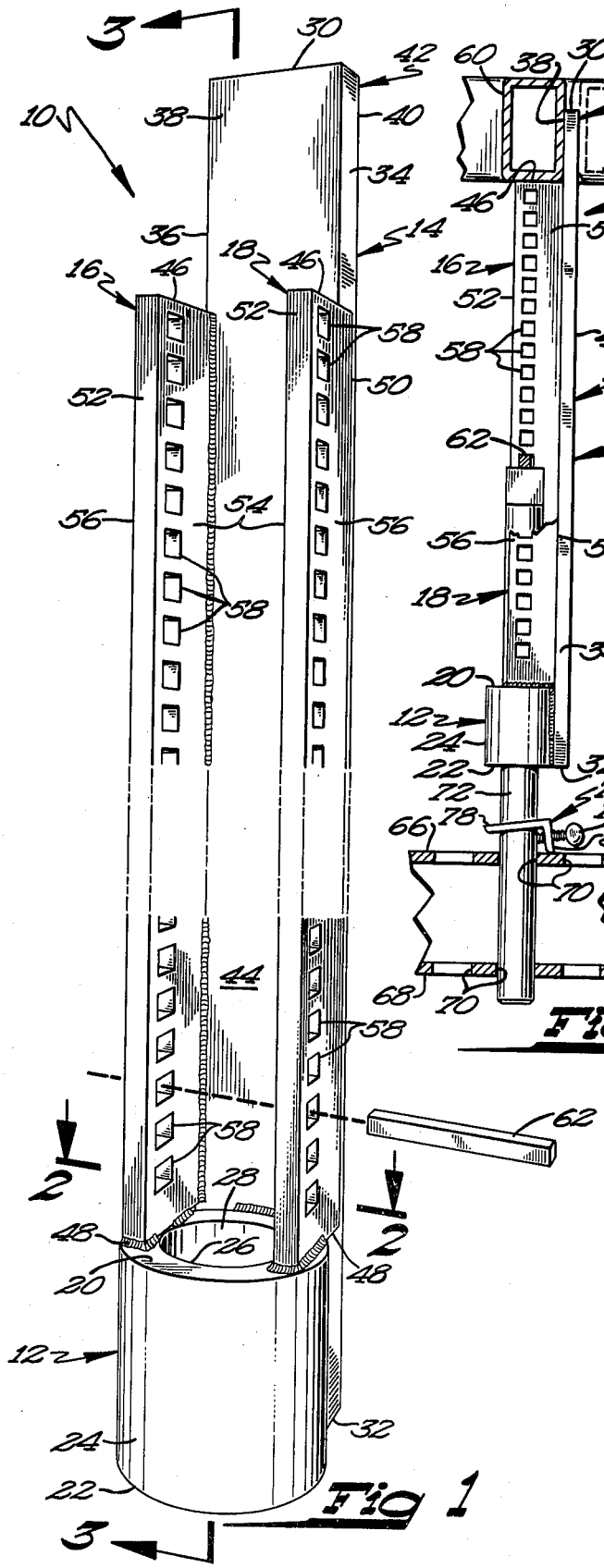
FIG. 1 is a partially exploded perspective view of the height extender utilizing the teachings of the present invention.

All figures are drawn for ease of explanation of the basic teachings of the present invention only; the extensions of the figures with respect to number, position, relationship, and dimensions of the parts to form preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures in the drawings, the same numerals designate the same or similar parts in the height extender. Furthermore, when the terms "right", "left", "front", "back", "vertical", "horizontal", "first", "second", and similar terms are used herein, it should be understood that these terms have reference only to the structure shown in the drawings as it would appear to a person viewing the drawings and are utilized only to facilitate describing the invention.

DESCRIPTION

In the figures, a height extender according to the teachings of the present invention is shown in use with an apparatus for repairing and straightening the body and frame of a vehicle and is generally designated 10. Extender 10 generally includes a bracelet or sleeve 12, a strong back plate 14, and first and second reinforcing or bracing members 16 and 18. Sleeve 12, in the preferred embodiment, is cylindrical and generally includes a top end 20, a bottom end 22, an outside surface 24, and an inside surface 26 which defines an aperture 28 extending therethrough. In the preferred embodiment, aperture 28 has a regular cross section and specifically has a circular cross section.

Back plate 14 includes a top end 30, a bottom end 32, a first side edge 34, a second side edge 36, a first surface 38, and a second surface 40. Back plate 14 generally includes a vehicle abutting portion 42 located adjacent top end 30 and an elongated bar member portion 44 comprising the lower and remaining part of plate 14. Surface 38 of bar member 44 adjacent end 32 is attached to surface 24 of sleeve 12 such as by welding as shown. Bar member 44 connects abutting portion 42 with sleeve 12 and vertically spaces portion 42 from and above sleeve 12.

Figure 2:
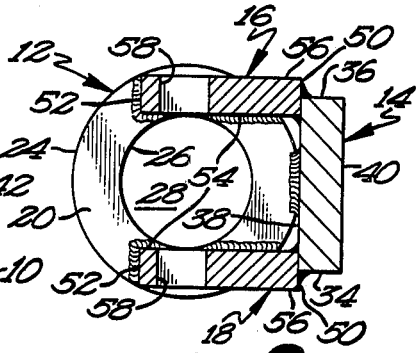
FIG. 2 is a cross sectional view of the height extender of FIG. 1 taken along section line 2—2 of FIG. 1.
Figure 3:
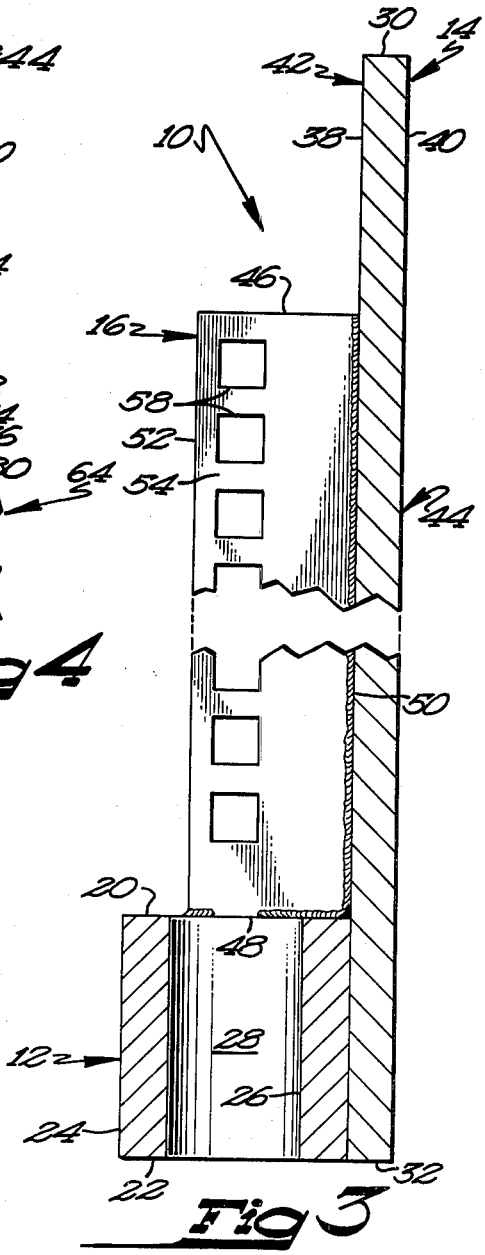
FIG. 3 is a cross sectional view of the height extender of FIG. 1 taken along section line 3—3 of FIG. 1.

Bracing members 16 and 18 generally include a top end 46, a bottom end 48, a first edge 50, a second edge 52, an inside surface 54, and an outside surface 56. First edges 50 of bracing members 16 and 18 are attached to edges 36 and 34 of back plate 14, respectively, such as by welding as shown. Bottom ends 48 of members 16 and 18 are attached to top end 20 of sleeve 12 such as by welding as shown. As best seen in FIG. 2, the cross section of bracing members 16 and 18 attached to plate 14 is generally U-shaped. Members 16 and 18 each include a vertical series of apertures 58 formed through surfaces 54 and 56. Apertures 58 are shown as rectangular in shape in the preferred embodiment, but can be of other shapes such as circular.

Figure 4:
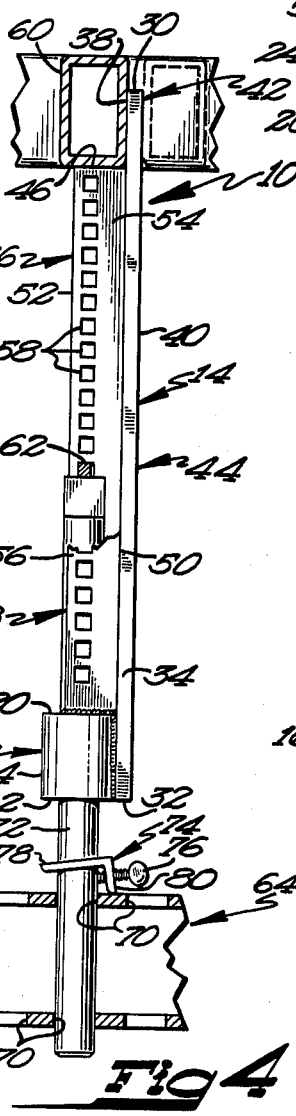
FIG. 4 is a side elevational view of the height extender of FIG. 1 in use according to the teachings of the present invention, with portions of the height extender being broken away.

In the preferred embodiment, top ends 46 of bracing members 16 and 18 are spaced from end 30 of abutting portion 42. Thus, abutting portion 42 can abut with the frame 60 or other anchor location of a vehicle to be repaired on either surface 38 as shown in solid in FIG. 4 or surface 40 as shown in phantom in FIG. 4. Furthermore, while surfaces 38 and 40 present large abutting areas to prevent anchor damage while a vehicle is being repaired, due to the spacing of top ends 46 of bracing members 16 and 18 from end 30 of abutting portion 42, portion 42 is of a flat and relatively small size and thus able to be positioned in tight anchor positions in the vehicle such as between the frame and rocker panel of the vehicle. It should be noted that when frame 60 of the vehicle abuts with surface 38 of abutting portion 42 as shown in solid in FIG. 4, ends 46 of bracing members 16 and 18 can also be abutted with frame 60.

Extender 10 further includes a pin 62 having a shape and size allowing insertion within apertures 58 and between inside surfaces 54 of members 16 and 18. Thus pin 62 extends between bracing members 16 and 18 which form the legs of the U-shaped cross section of bracing members 16 and 18 and plate 14. In the preferred embodiment, pin 62 has a square cross section corresponding to apertures 58 of members 16 and 18, but other cross sections of pin 62, such as circular, will be obvious to persons skilled in the art after the teachings of the present invention are understood.

The apparatus for repairing and straightening the body and frame of vehicles in which extender 10 of the present invention is used may be of the type as set forth in U.S. Pat. No. 4,151,737. The apparatus generally includes structure for receiving the counterforces from the vehicle produced or resulting from the application of the repair force to the vehicle such as the super structure of the apparatus or the tread member 64 of the type as shown in U.S. Pat. No. 4,151,737 and in FIG. 4. In the preferred form, tread member 64 allows the placement of the vehicle directly thereon, and generally includes a top plate 66 and a bottom plate 68. A plurality of apertures 70 extend vertically through plates 66 and 68 of tread member 64. In the preferred embodiment, apertures 70 are regular in shape and specifically are circular.

The counterforce receiving structure of the apparatus for repairing and straightening further includes an upright member, shown in the preferred embodiment as a bolster 72 removably received in aperture 70. Bolster 72 is removably held in aperture 70 of tread member 64 by L-shaped locking member 74. In the preferred embodiment, due to the increased weight placed upon locking member 74 as a result of the placement of extender 10 thereon, locking member 74 further includes a locking screw 76 threadably received in locking member 74 and which abuts with bolster 72 to prevent bolster 72 from sliding relative to locking member 74. Specifically, locking member 74 includes a first, elongated leg 78 and a second, shorter leg 80, with screw 76 being threadably received in leg 80.

Now that the structure of extender 10 according to the teachings of the present invention has been set forth, the operation, advantages, and subtle features of the present invention can be explained and appreciated.

Due to the fact that four wheel drive type vehicles, pickup type vehicles, and other high ground clearance vehicles are becoming more popular, a need has arisen for devices for rapidly anchoring damaged high ground clearance vehicles in apparatus for repairing and straightening with the minimum expenditures of time and energy. Prior to the present invention, when it became necessary to repair a damaged high ground clearance vehicle, it was necessary to use many tie down methods on the same vehicle, such as four tie down chains going the four major directions of the compass to the underside of the vehicle. In addition, many times pyramid type blocking set ups were required to keep the vehicle from sinking from the repair force. In addition to the four way tie down chains, in many cases, additional vertically positioned tie down chains were required. As a result, in order to repair a high ground clearance vehicle in the past, it was necessary to spend large amounts of time and effort in merely tying the vehicle down.

Further, in many cases, due to the fact that the frame of the vehicle is a large distance above the counterforce accepting structure of the repairing and straightening apparatus, extreme cantilever type counterforces were placed on the apparatus. Specifically, cantilever type counterforces are torque or twising forces produced by a force being accepted at a point spaced from the supporting, anchoring, or force accepting structure. Cantilever type counterforces are especially prone to be produced when a force is accepted on the unsupported end of a projecting member supported only at the opposite end, such as a cantilever. Extreme cantilever type counterforces produced in the prior art could damage the apparatus for repairing and straightening or require the apparatus to be manufactured of exceeding strong components, and thus are highly undesirable.

Furthermore, since many high ground clearance vehicles, such as four wheel drive pickups, are of a much stronger construction than standard clearance vehicles, such as passenger automobiles, the repair forces necessary to repair and straighten damage high ground clearance vehicles are considerably greater than for standard clearance vehicles. Thus, the counterforces transmitted by the high ground clearance vehicle at the anchor locations are also considerably greater. These greater counterforces transmitted by the vehicle have been known to cause tie down or anchor damage to the vehicle itself while the vehicle was being repaired. Thus, yet more time was necessary to remove this anchor damage, including extra amounts of blacksmithing time.

Still further, in order to anchor the vehicle by the several tie down methods of previous methods, in many cases the vehicle had to be taken apart or stripped, thus greatly increasing the time necessary to repair the vehicle.

With the use of one or more height extenders 10 according to the teachings of the present invention, anchoring of high ground clearance vehicles can be performed quickly and simply. Specifically, a block or slug is obtained of a size allowing its placement under leg 78 of locking member 74 such that leg 78 of locking member 74 is level and does not cant on bolster 72. Pin 62 is then placed in apertures 58 of extender 10 such that pin 62 extends between bracing members 16 and 18 and is supported in apertures 58 for abutting with the top of bolster 72.

The slug and locking member 74 are placed on plate 66 over aperture 70 formed in tread member 64 directly under the point of the vehicle desired to be anchored or secured such as frame 60. Extender 10 is then placed on top of leg 78 of locking member 74 as leveled by the slug. Bolster 72 may then be slid up through aperture 70 from below plate 68, through plate 66, through locking member 74, and through aperture 28 of sleeve 12 until the top of bolster 72 engages pins 62 located in apertures 58. Upon further upward movement of bolster 72, extender 10 may also be vertically raised with bolster 72 because pin 62 prevents further relative movement between extender 10 and bolster 72 in that extender 10 is supported on bolster 72 by sleeve 12 and pin 62. Bolster 72 and extender 10 may then be raised until abutting portion 42 engages at the desired vehicle anchor location such as frame 60. The slug under locking member 74 can then be removed allowing locking member 74 to cant on bolster 72. Bolster 72 with extender 10 located thereon can be released and will then be held in the vertical position in aperture 70 by locking member 74. Screw 76 in locking member 74 can then be tightened against bolster 72 to prevent locking member 74 from uncanting and thus sliding on bolster 72 to thus act as a safe keep lock to locking member 74.

It may be desired to have the bottom end of bolster 72 flush with the bottom surface of tread member 64 or, in other words, bottom plate 68 such that no obstructions exist to the free movement of the force applying means in the apparatus for repairing and straightening. Thus, the force applying means can be moved in the apparatus for repairing and straightening to several repair locations during repair of the vehicle without necessitating the removal of bolster 72 from tread member 64. Extender 10 allows bolster 72 to be positioned within aperture 70 of tread member 64 such that no obstructions are made below plate 68 of tread member 64. Specifically, pin 62 can be positioned in any one of the set of the multitudinous apertures 58 between members 16 and 18 and thus can be positioned in the set of apertures 58 such that abutting portion 42 abuts with the desired anchor locations such as frame 60 and such that the bottom end of bolster 72 may be raised to be flush with plate 68 of tread member 64.

Thus, it should be noted that extender 10 can be positioned by two independent methods. First, bolster 72 with extender 10 located thereon can be raised through aperture 70 of tread member 64 until abutting portion 42 abuts with the anchor location such as frame 60. Second, pin 62 can be located in any of the multitudinous apertures 58 such that the location of extender 10 on bolster 72 can be changed relatively. It should further be noted that it is highly preferred to locate pin 62 in apertures 58 such that sleeve 12 is located as close to tread member 64 as possible to reduce cantilever type counterforces. Additionally, if the feature of allowing the positioning of bolster 72 in tread member 64 such that no obstructions are presented below tread member 64 is not desired and if the feature of the great range of high ground clearance distances of extender 10 is not desired but rather the use of extender 10 is restricted to particular high ground clearance distances, pin 62 and apertures 58 could be replaced by a single location or by other fixed bolster positioning apparatus. For example, a bar or plate could be welded between bracing members 16 and 18 at a single, preset location.

It can now be appreciated that elongated portion 44 is of a length allowing sleeve 12 to be located adjacent to tread member 64. This greatly reduces the cantilever type counterforces transferred to tread member 64 by reducing the distance between the point where the counterforces are transferred to bolster 72 and tread member 64 and thus reducing the lever arm which creates cantilever type counterforces. This is specifically true since cantilever type forces are directly related to the counterforce transferred and also to the lever arm which is the distance that counterforce is transferred from the supported end of the upright member, which in the preferred embodiment, is at the intersection of bolster 72 and tread member 64. Thus by reducing the spacing of sleeve 12, which transfers the counterforces to bolster 72, from tread member 64, the cantilever type counterforces may be reduced by a multiplicative factor.

Furthermore, elongated portion 44 is parallel to aperture 28 of sleeve 12 such that when bolster 72 is located within aperture 28 of sleeve 12 of extender 10, elongated portion 44 is spaced from bolster 72. Further, elongated portion 44 does not contact bolster 72 at any time when a counterforce is transferred from the vehicle to bolster 72 by extender 10. If elongated portion 44 would contact bolster 72, at least a portion of the counterforce would be transferred by elongated portion 44 to bolster 72, which would create large cantilever type counterforces due to the greater spacing thereof in comparison to sleeve 12 and tread member 64, or in other words, would create a larger lever arm. Thus, elongated portion 44 is spaced from bolster 72, according to the present invention, for preventing counterforces from being transferred from elongated portion 44 to bolster 72 and with the transference of all counterforces to bolsters 72 being by sleeve 12 adjacent to tread member 64 to avoid an undue amount of cantilever type counterforce into tread member 64 and bolster 72.

Bracing members 16 and 18 insure that elongated portion 44 does not contact bolster 72 at all times when a counterforce is transferred from the vehicle to bolster 72 by extender 10. It should be noted that bracing members 16 and 18 may contact bolster 72. However, bracing members 16 and 18 are parallel to the counterforce received by abutting portion 42 and transferred by elongated portion 44. Therefore, bracing member 16 and 18 transfer either minimal or no counterforces to bolster 72 and thus create either minimal or no cantilever type counterforces.

Although extender 10 is preferably utilized by having abutting portion 42 directly contact the vehicle anchor location such as frame 60, extender 10 can also be utilized with a chain extending between extender 10 and the vehicle. Such utilization may be made when extender 10 is too tall to fit underneath the vehicle. Further, such utilization may be made when it is desired to maintain levelness, that is receiving the counterforce at a level that is considerably above the support surface, such as tread member 64.

The utilization of extender 10 greatly reduces the time and energy required to anchor the vehicle which was required when support pyramids were used as in the prior art. Further, extender 10 does not present the dangers created by the support pyramids at least because extender 10 will not topple as support pyramids can. It should be remembered that when extender 10 is utilized in conjunction with a chain, extender 10 also obtains the same and similar advantages set forth hereinbefore including the transference of all counterforces to bolster 72 by sleeve 12 adjacent tread member 64.

Extender 10 may also be utilized in repairing body parts on vehicles. Specifically, one or more extenders 10 can be strategically located to hold the body parts on the vehicle to allow a repair force to be applied in straightening the body parts. It may be desired to place padding material between abutting portion 42 and the body parts to prevent abutting portion 42 from damaging body parts.

Aperture 28 is of a size corresponding to bolster 72 such that sleeve 12 is closely fit on bolster 72 to assist in transferring the counterforces by sleeve 12 to bolster 72 and to prevent sleeve 12 from damaging bolster 72. Further, the close tolerance fit of sleeve 12 on bolster 72 prevents extender 10 from canting on bolster 72 allowing plate 14 to contact bolster 72 and thus undesirably transfer counterforces.

Further, due to the regular cross section of bolster 72 and apertures 28 and 70, extender 10 can receive counterforces from any direction 360° around extender 10. Specifically, due to the circular cross section of aperture 28 and bolster 72, extender 10 can be rotated on bolster 72 such that extender 10 can accept counterforces from any direction 360° around bolster 72. Further, and independently, due to the circular cross section of aperture 70 and bolster 72, bolster 72 with extender 10 located thereon can be rotated in aperture 70 such that extender 10 can accept counterforces from any direction 360° around bolster 72.

Thus, extender 10 with the improved locking member 74 including screw 76 can be utilized to hold a vehicle against a repair force from any direction except for vertically upward. However, in conjunction with a suitable tie down member, such as a tie down chain, extender 10 can also be utilized to resist a repair force applied vertically upward.

It should also be noted that since sleeve 12 transfers counterforces to bolster 72 adjacent to tread member 64, the size of the cross section of bolster 72 can be smaller and still resist bending. Further, bolster 72 can be made of a shorter length when it is utilized with extender 10. This smaller bolster is then of lesser weight making it more convenient and making it more efficient in time and energy to carry and position within tread member 64.

Now that the basic teachings of the present invention have been explained, many extensions and variations beyond those set forth will be obvious to one having ordinary skill in the art. Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. In an apparatus for repairing and straightening the body and frame of a high ground clearance wheeled vehicle including a tread member allowing the placement of the vehicle thereon, with the tread member including a plurality of apertures vertically passing therethrough, a bolster removably received in the tread apertures, and means for locking the bolster in the tread apertures, and with the bolster and tread member being adapted for receiving counterforces from the vehicle, the improvement comprising a removable, bolster height extender comprising, in combination: means for abutting with the vehicle; a sleeve member slidably mounted on the bolster for transferring counterforces to the bolster, with the sleeve member having an aperture of a size allowing receipt of the bolster; an elongated bar member connecting the abutting means with the sleeve member and vertically spacing the abutting means above the sleeve member, with the elongated bar member being spaced from the bolster when the bolster is received in the aperture of the sleeve member for preventing counterforces from being transferred directly from the elongated bar member to the bolster; first and second elongated brace members upstanding from and attached to the sleeve member and attached to the elongated bar member for insuring that the elongated bar member does not contact the bolster at all times when a counterforce is transferred from the vehicle to the bolster by the height extender, with the first and second elongated brace members including a series of positioning apertures passing therethrough; and a pin received in the positioning apertures of the first and second elongated brace members which abutts with and is supported on the bolster received in the sleeve member to allow the multilevel positioning of the height extender on the bolster, and with the sleeve member transferring all counterforces received by the height extender to the bolster adjacent to the tread member to avoid an undue amount of cantilever type counterforce into the tread member or the bolster.

2. The height extender of claim 1 wherein the aperture of the sleeve member has a regular cross section.

3. The height extender of claim 2 wherein the aperture of the sleeve member has a circular cross section and further has a close tolerance fit with the bolster for preventing the sleeve member and the extender from canting on the bolster.

4. In an apparatus for repairing and straightening the body and frame of a wheeled vehicle including structure for receiving counterforces from the vehicle resulting from the application of the repair force to the vehicle, with the structure including an upright member having a top, the improvement comprising a height extender removably positioned on the upright member comprising, in combination: means for abutting with the vehicle and for receiving a counterforce therefrom; means slideably received on the upright member for transferring counterforces to the upright member; means for connecting the abutting means with the counterforce transferring means and for vertically spacing the abutting means from the counterforce transferring means, with the connecting means being spaced from the upright member for preventing counterforces from being transferred from the connecting means directly to the upright member and with the transference of all counterforces to the upright member being by the counterforce transferring means adjacent to the structure for receiving counterforces to avoid an undue amount of cantilever type counterforce into the structure or the upright member; and means for allowing the multi-level positioning of the height extender in relation to the upright member comprising, in combination: a pin; and means for positioning the pin at multitudinous locations spaced from the counterforce transferring means for abutting with the top of the upright member when the upright member is slideably received in the counterforce transferring means.

5. The height extender of claim 4 wherein the counterforce transferring means is slidably mounted on the upright member.

6. The height extender of claim 5 wherein the counterforce transferring means comprises, in combination: a sleeve member having an outside surface, a top end, a bottom end, and an inside surface defining an aperture passing therethrough.

7. The height extender of claim 6 wherein the aperture passing through the counterforce transferring means has a regular cross section.

8. The height extender of claim 7 wherein the aperture passing through the counterforce transferring means has a circular cross section and further has a close tolerance fit with the upright member for preventing the height extender from canting on the upright member.

9. The height extender of claim 4 wherein the abutting means comprises a flat and relatively small plate having large abutting areas to prevent anchor damage while a vehicle is being repaired and allowing positioning in tight anchor positions in the vehicle.

10. The height extender of claim 4 further comprising, in combination: means for bracing the connecting means for insuring that the connecting means remains spaced from the upright member and does not contact the upright member at all times when a counterforce is transferred from the vehicle to the upright member by the height extender.

11. The height extender of claim 10 wherein the bracing means comprises, in combination: first and second elongated bracing members having top and bottom ends, first and second edges, and inside and outside surfaces, with the bottom ends of the bracing members being attached to the counterforce transferring means and with the first edges of the bracing members being attached to the connecting means.

12. The height extender of claim 11 wherein the pin positioning means comprises, in combination: a series of positioning apertures formed in the first and second elongated bracing members for receiving the pin.

13. In an apparatus for repairing and straightening the body and frame of a wheeled vehicle including structure for receiving counterforces from the vehicle resulting from the application of the repair force to the vehicle, with the structure including an upright member, the improvement comprising a height extender removably positioned on the upright member comprising, in combination: means for abutting with the vehicle and for receiving a counterforce therefrom; means received on the upright member for transferring counterforces to the upright member, with the counterforce transferring means having a top end; means for connecting the abutting means with the counterforce transferring means and for vertically spacing the abutting means from the counterforce transferring means, with the connecting means being spaced from the upright member for preventing counterforces from being transferred from the connecting means directly to the upright member and with the transference of all counterforces to the upright member being by the counterforce transferring means adjacent to the structure for receiving counterforces to avoid an undue amount of cantilever type counterforce into the structure or the upright member; and means attached to the top end of the counterforce transferring means and to the connecting means for bracing the connecting means for insuring that the connecting means remains spaced from the upright member and does not contact the upright member at all times when a counterforce is transferred from the vehicle to the upright member by the height extender.

14. The height extender of claim 13 further comprising, in combination: means for allowing the multi-level positioning of the height extender in relation to the upright member.

15. The height extender of claim 14 wherein the connecting means comprises, in combination: an elongated bar member connected to the abutting means and the counterforce transferring means.

16. The height extender of claim 4 or 13 wherein the structure includes apertures passing vertically therethrough and wherein the upright member comprises, in combination: a bolster; and a locking member for removably holding the bolster in the structure aperture comprising, in combination: an L-shaped member having a first, elongated leg and a second, shorter leg, with an aperture being formed in the first leg for receiving and canting on the bolster, with improvement comprising a screw threadably received in the second leg for abutting with the bolster for preventing the bolster from sliding relative to the L-shaped member.

17. In an apparatus for repairing and straightening the body and frame of a wheeled vehicle including structure for receiving counterforces from the vehicle resulting from the application of the repair force to the vehicle, with the structure including an upright member, the improvement comprising a height extender removably positioned on the upright member comprising, in combination: means for abutting with the vehicle and for receiving a counterforce therefrom; means received on the upright member for transferring counterforces to the upright member; means for connecting the abutting means with the counterforce transferring means and for vertically spacing the abutting means from the counterforce transferring means, with the connecting means being spaced from the upright member for preventing counterforces from being transferred from the connecting means directly to the upright member and with the transference of all counterforces to the upright member being by the counterforce transferring means adjacent to the structure for receiving counterforces to avoid an undue amount of cantilever type counterforce into the structure or the upright member, wherein the counterforce transferring means is slideably mounted on the upright member and comprises, in combination: a sleeve member having an outside surface, a top end, a bottom end, and an inside surface defining an aperture passing therethrough, wherein the connecting means comprises, in combination: an elongated bar member connected to the abutting means and the counterforce transferring means; means for allowing the multi-level positioning of the height extender in relation to the upright member; and means for bracing the connecting means for insuring that the connecting means remains spaced from the upright member and does not contact the upright member at all times when a counterforce is transferred from the vehicle to the upright member by the height extender comprising, in combination: first and second elongated bracing members having top and bottom ends, first and second edges, and inside and outside surfaces, with the bottom ends of the bracing members being attached to the counterforce transferring means and with the first edges of the bracing members being attached to the connected means.

18. The height extender of claim 17 wherein the multi-level positioning means comprises, in combination: a series of positioning apertures formed in the first and second elongated bracing members; and a pin received in the positioning apertures allowing the pin to abut against and be supported by the upright member to position the height extender at the desired position on the upright member.

* * * * *